US009520669B2

(12) United States Patent
Gerwatowski et al.

(10) Patent No.: US 9,520,669 B2
(45) Date of Patent: Dec. 13, 2016

(54) CONNECTOR ASSEMBLY WITH MALE TERMINAL PROTECTOR

(71) Applicant: Yazaki North America, Inc., Canton, MI (US)

(72) Inventors: Justin T. Gerwatowski, Northville, MI (US); Jonathan P. Miller, Farmington, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 14/280,855

(22) Filed: May 19, 2014

(65) Prior Publication Data

US 2015/0333431 A1 Nov. 19, 2015

(51) Int. Cl.

| | |
|---|---|
| ***H01R 13/62*** | (2006.01) |
| ***H01R 13/44*** | (2006.01) |
| ***H01R 13/629*** | (2006.01) |
| ***H01R 13/453*** | (2006.01) |
| *H01R 13/506* | (2006.01) |

(52) U.S. Cl.

CPC ..... *H01R 13/44* (2013.01); *H01R 13/4538* (2013.01); *H01R 13/62933* (2013.01); *H01R 13/506* (2013.01); *H01R 13/62938* (2013.01)

(58) Field of Classification Search

CPC . H01R 13/4538; H01R 13/447; H01R 13/631; H01R 13/5213

USPC ..... 439/139, 140, 141, 142, 157, 357

See application file for complete search history.

(56) References Cited

U.S. PATENT DOCUMENTS 5,252,084 A * 10/1993 Wakata ..... H01R 13/62955 439/157
5,437,558 A 8/1995 Sakuraoka et al.
5,486,117 A 1/1996 Chang
5,575,685 A 11/1996 Ittah et al.
(Continued)

FOREIGN PATENT DOCUMENTS

EP 1443607 A2 8/2004
EP 1672747 A1 6/2006
(Continued)

OTHER PUBLICATIONS

Extended European Search Report regarding Application No. 15167983.4, dated Jul. 17, 2015.
(Continued)

*Primary Examiner* — Tho D Ta
*Assistant Examiner* — Thang Nguyen
(74) *Attorney, Agent, or Firm* — Harness, Dickey & Pierce, P.L.C.

(57) ABSTRACT

A connector assembly that includes first and second connector housings, which are configured to hold a plurality of male terminals, a pair of lock tabs, which are disposed on opposite sides of the first connector housing, and a male terminal protector that is engaged to the lock tabs to protect ends of the male terminals that are to engage the female terminals when the second connector housing is fully mated to the first connector housing. The male terminal protector is released from the lock tabs when the second connector housing is positioned in a connector pre-set condition so that they do not impede movement of the male terminal protector when the second connector is moved toward the first connector housing to align and mate the female terminals with the male terminals.

6 Claims, 5 Drawing Sheets

(56) References Cited

U.S. PATENT DOCUMENTS

| | | | | |
|---|---|---|---|---|
| 5,575,692 | A | 11/1996 | Cecil, Jr. et al. | |
| 6,095,833 | A | 8/2000 | Osawa | |
| 6,325,647 | B1 * | 12/2001 | May | H01R 13/6295 439/157 |
| 6,390,834 | B1 | 5/2002 | Hofmeister et al. | |
| 6,422,881 | B1 * | 7/2002 | Puhl | H01R 13/4538 439/140 |
| 6,565,372 | B2 * | 5/2003 | Bakker | H01R 13/4538 439/157 |
| 6,634,907 | B2 | 10/2003 | Takatsuki et al. | |
| 6,644,992 | B2 | 11/2003 | Maegawa | |
| 6,666,698 | B2 | 12/2003 | Beck, Jr. et al. | |
| 6,685,506 | B1 | 2/2004 | Nakamura et al. | |
| 6,692,274 | B2 | 2/2004 | Maegawa | |
| 6,761,568 | B2 | 7/2004 | Bakker et al. | |
| 6,783,388 | B2 | 8/2004 | Matsushita | |
| 6,846,191 | B2 * | 1/2005 | Hobbs | H01R 13/4538 439/140 |
| 6,854,992 | B2 * | 2/2005 | Martin | H01R 13/62944 439/157 |
| 6,878,001 | B2 | 4/2005 | Nishide | |
| 6,887,089 | B2 | 5/2005 | Nishide | |
| 6,896,531 | B2 * | 5/2005 | Bakker | H01R 13/4538 439/140 |
| 6,976,858 | B1 | 12/2005 | Kikuchi et al. | |
| 7,134,901 | B2 | 11/2006 | Okura | |
| 7,234,952 | B2 | 6/2007 | Sasaki et al. | |
| 7,249,958 | B2 | 7/2007 | Ishikawa et al. | |
| 7,267,562 | B2 * | 9/2007 | Katsuma | H01R 13/4538 439/140 |
| 7,329,133 | B2 | 2/2008 | Ishikawa | |
| 7,427,205 | B2 | 9/2008 | Sasaki et al. | |
| 7,459,887 | B2 | 12/2008 | Hatanaka | |
| 7,549,887 | B1 | 6/2009 | Ng et al. | |
| 7,581,969 | B2 | 9/2009 | Matsushita | |
| 7,588,446 | B2 * | 9/2009 | Kobayashi | H01R 13/62933 439/135 |
| 7,588,455 | B2 | 9/2009 | Matsumura et al. | |
| 7,670,177 | B2 * | 3/2010 | Myer | H01R 13/4365 439/595 |
| 8,038,455 | B1 * | 10/2011 | Moraes | H01R 13/4538 439/140 |
| 8,075,351 | B2 | 12/2011 | Park et al. | |
| 8,147,261 | B2 | 4/2012 | Horiuchi | |
| 2002/0168895 | A1 | 11/2002 | Suzuki | |
| 2003/0003786 | A1 | 1/2003 | Bakker et al. | |
| 2003/0119349 | A1 * | 6/2003 | Bakker | H01R 13/4538 439/140 |
| 2004/0147158 | A1 * | 7/2004 | Hobbs | H01R 13/4538 439/378 |
| 2004/0166711 | A1 * | 8/2004 | Uchida | H01R 13/6275 439/140 |
| 2005/0059280 | A1 | 3/2005 | Hobbs et al. | |
| 2006/0205264 | A1 | 9/2006 | Katsuma | |
| 2007/0287310 | A1 * | 12/2007 | Dekoski | H01R 13/62938 439/157 |
| 2011/0124213 | A1 * | 5/2011 | Dekoski | H01R 13/62938 439/157 |
| 2015/0380857 | A1 | 12/2015 | Mingo et al. | |

FOREIGN PATENT DOCUMENTS

| | | | |
|---|---|---|---|
| EP | 2448068 | A1 | 5/2012 |
| EP | 2772993 | A1 | 9/2014 |
| EP | 2947722 | A1 | 11/2015 |
| JP | 2001326012 | A | 11/2001 |
| JP | 2004265686 | A | 9/2004 |
| JP | 2006253074 | A | 9/2006 |
| JP | 2009187865 | A | 8/2009 |
| WO | WO-2008062389 | A2 | 5/2008 |
| WO | 2010015891 | A1 | 2/2010 |

OTHER PUBLICATIONS

Japanese Office Action issued Mar. 15, 2016 in corresponding Japanese Application No. 2015-082618. English translation of Office Action provided by Harakenzo.

Yazaki Corporation Part No. 7282-0259, SMJ 83P Connector Male Subassembly (Apr. 2006).

* cited by examiner

CONNECTOR ASSEMBLY WITH MALE TERMINAL PROTECTOR

FIELD

The present disclosure relates to a connector assembly with a male terminal protector.

BACKGROUND

This section provides background information related to the present disclosure which is not necessarily prior art.

Mating connector assemblies are used extensively in various industries, including the automotive industry, to couple sets of electrical conductors to one another. A relatively recent development is related to a floating alignment member of the type that is disclosed in U.S. Pat. No. 7,670,177. The floating alignment member is slidably received in a male connector housing and is configured to move between an extended position and a retracted position. The floating alignment member is disposed in the extended position prior to the mating of a female connector housing with the male connector housing and is moved to its retracted position when the female connector housing is moved to a position where it is fully mated to the male connector housing. While such configuration is suited for its intended purpose, we have noted several drawbacks. For example, the floating alignment member is locked to the male connector housing and the unlocking force that is required to unlock it from the male connector housing is added to the force that is required to seat the female connector housing to the male connector housing. It will be appreciated that the force required to mate the female connector housing to the male connector housing can be greatly affected by the quantity of electrical conductors that are to be mated to one another. In instances where a relatively large quantity of electrical conductors are to be coupled to one another, the force to fully mate the female connector housing to the male connector housing can be relative high. Moreover, it can be undesirable to time the unlocking of the floating alignment member from the male connector housing at the same time that the mating male and female terminal elements (carried by the male and female connector housings, respectively) are initially being aligned and engaged to one another. Accordingly, there remains a need in the art for an improved connector assembly with a male terminal protector.

SUMMARY

This section provides a general summary of the disclosure, and is not a comprehensive disclosure of its full scope or all of its features.

In one form, the present teachings provide a connector assembly that includes a first connector housing, a plurality of male terminals, a pair of lock tabs, and a male terminal protector. The first connector housing has a first connector body and a shroud member that is coupled the first connector body and defines a connector housing cavity that is disposed about a mating axis. The first connector body defines a plurality of first terminal apertures that are formed parallel to the mating axis and which intersect the connector housing cavity. The male terminals are fixedly coupled to the first connector housing. Each of the male terminals is received in one of the first terminal apertures and has a portion that extends into the connector housing cavity. The lock tabs are disposed on opposite sides of the first connector housing. Each of the lock tabs has a first lock tooth, a second lock tooth, and a lock recess that is disposed between the first and second lock teeth. Each of the first lock teeth is disposed on a distal end of an associated one of the lock tabs. The male terminal protector is slidably received in the connector housing cavity and is movable along the mating axis. The male terminal protector has a body, a plurality of terminal openings that are formed through the body, and a pair of lock projections. The terminal openings are disposed in-line with the male terminals. The lock projections are configured to deflect the lock tabs outwardly from the first connector housing as the male terminal protector is moved along the mating axis toward the male terminals. The lock projections are disposed in the lock recesses to position the male terminal protector in a protector pre-set position. The portions of the male terminals that extend into the connector housing cavity are disposed between first connector body and the male terminal protector when the male terminal protector is in the protector pre-set position. The male terminal protector is moveable along the mating axis toward the first connector body into a protector full-set position in which the portions of the male terminals extend through the male terminal protector.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
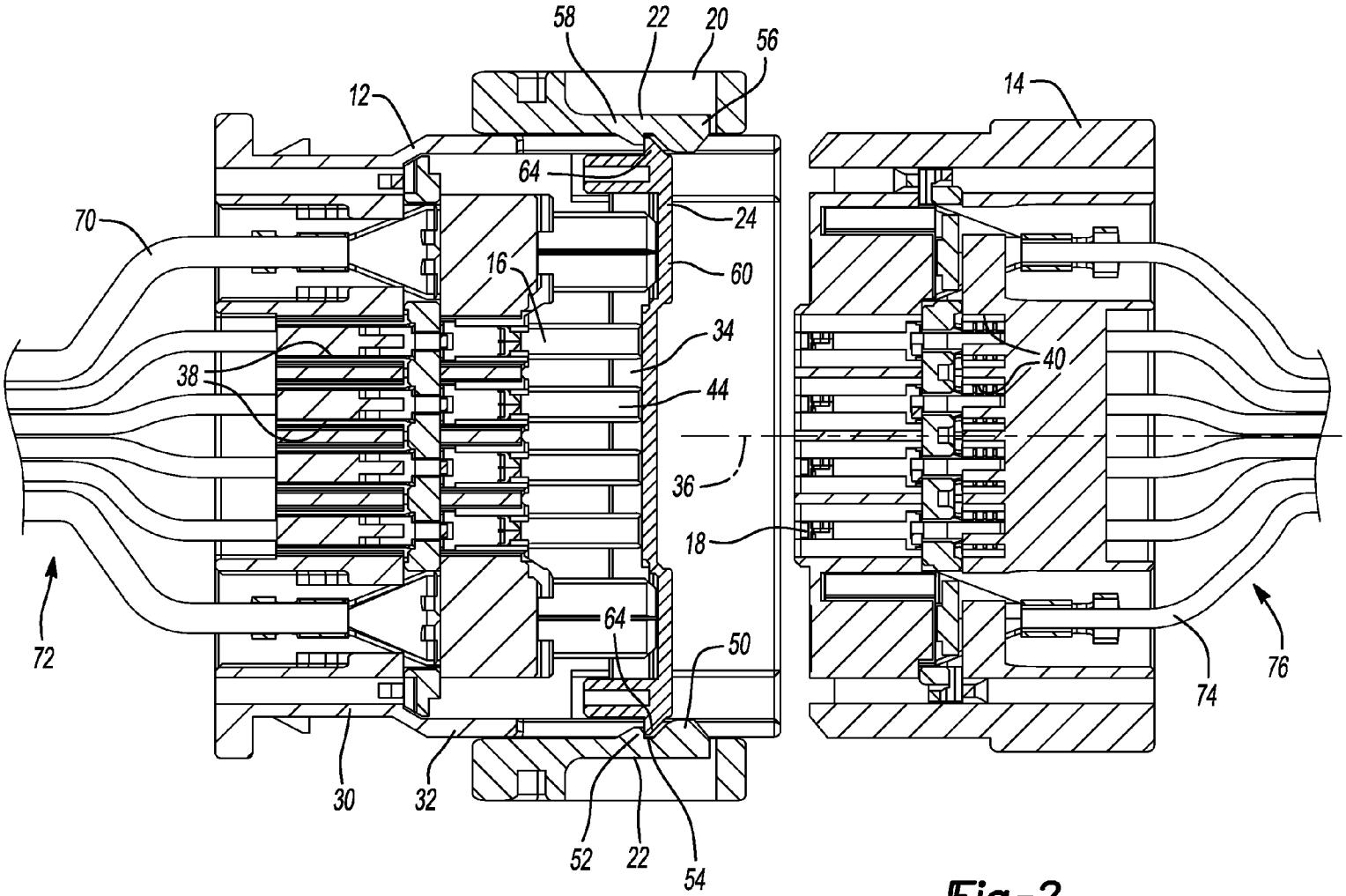
FIG. 2 is an section view of the connector assembly of FIG. 1 taken along the line 2-2 and depicting a second connector housing as exploded from a remaining portion of the connector assembly, the connector assembly further being depicted as being coupled to the electrical conductors of a pair of wire harnesses.
Figure 6:
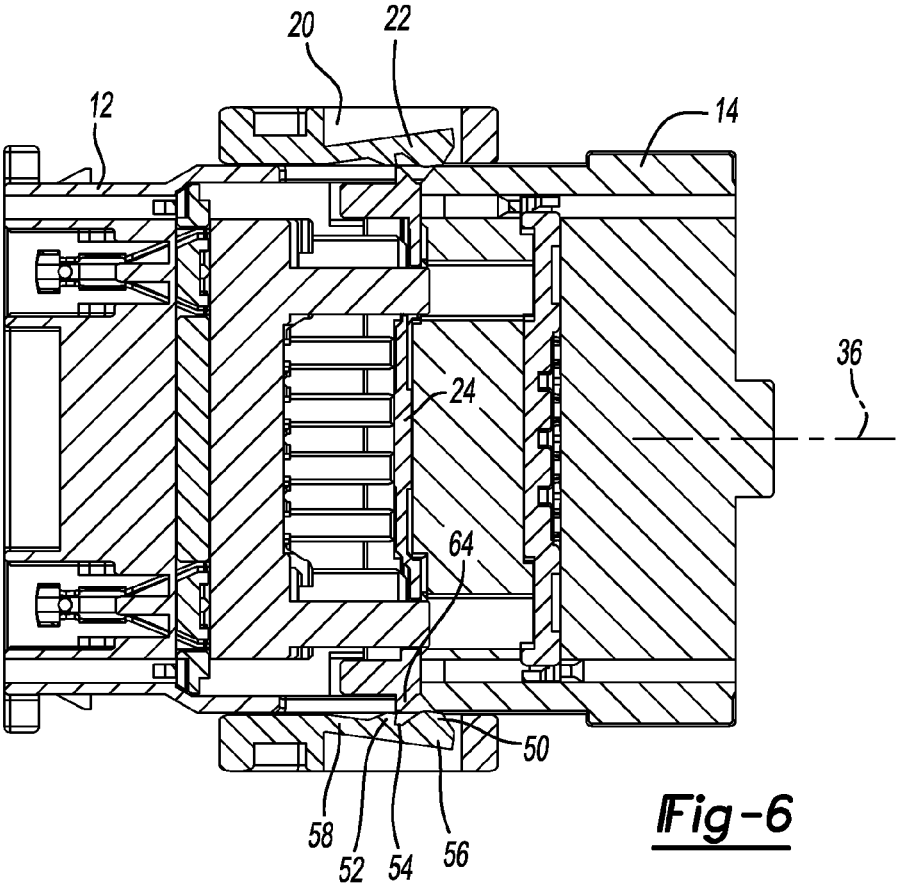
Figure 7:
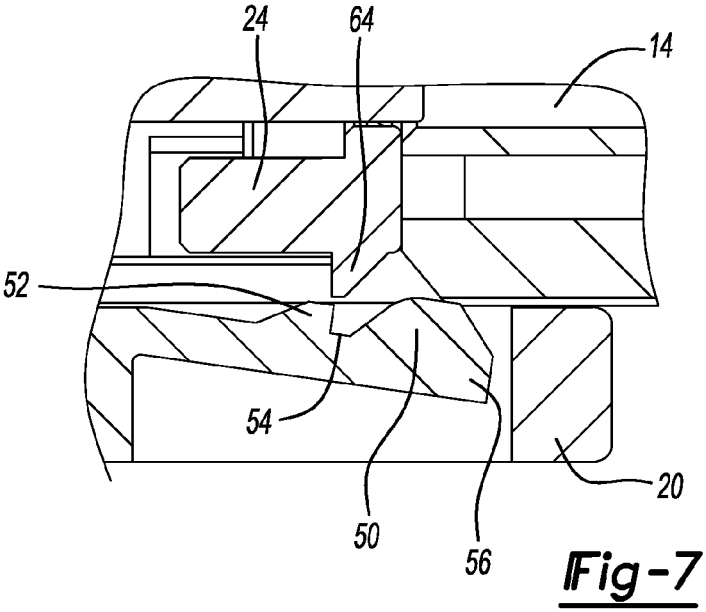

FIG. 6 is a view similar to that of FIG. 2 but depicting the second connector housing positioned relative to the first connector housing in a connector pre-set position; and FIG. 7 in an enlarged portion of FIG. 6, showing in more detail contact between the second connector housing and a first lock tooth on a lock tab that causes the lock tab to flex outwardly from the first connector housing to cause the lock tab to disengage the male terminal protector.

Corresponding reference numerals indicate corresponding parts throughout the several views of the drawings.

DETAILED DESCRIPTION

Figure 1:
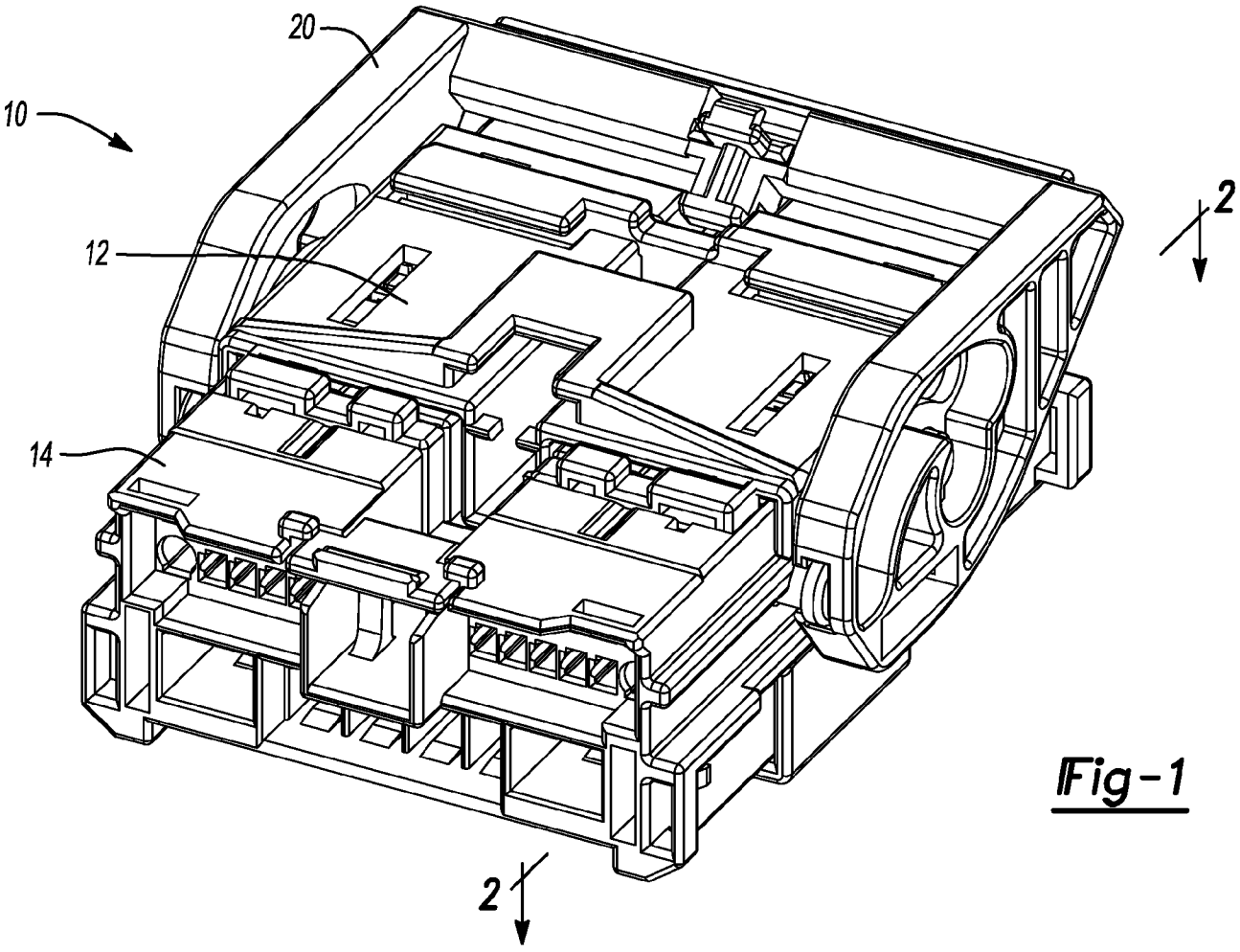
FIG. 1 is a perspective view of a connector assembly constructed in accordance with the teachings of the present disclosure.

With reference to FIGS. 1 and 2 of the drawings, a connector assembly constructed in accordance with the teachings of the present disclosure is generally indicated by reference numeral 10. The connector assembly 10 can include a first connector housing 12, a second connector housing 14, a plurality of male terminals 16, a plurality of female terminals 18, a lever 20, a pair of lock tabs 22, and a male terminal protector 24.

Figure 3:
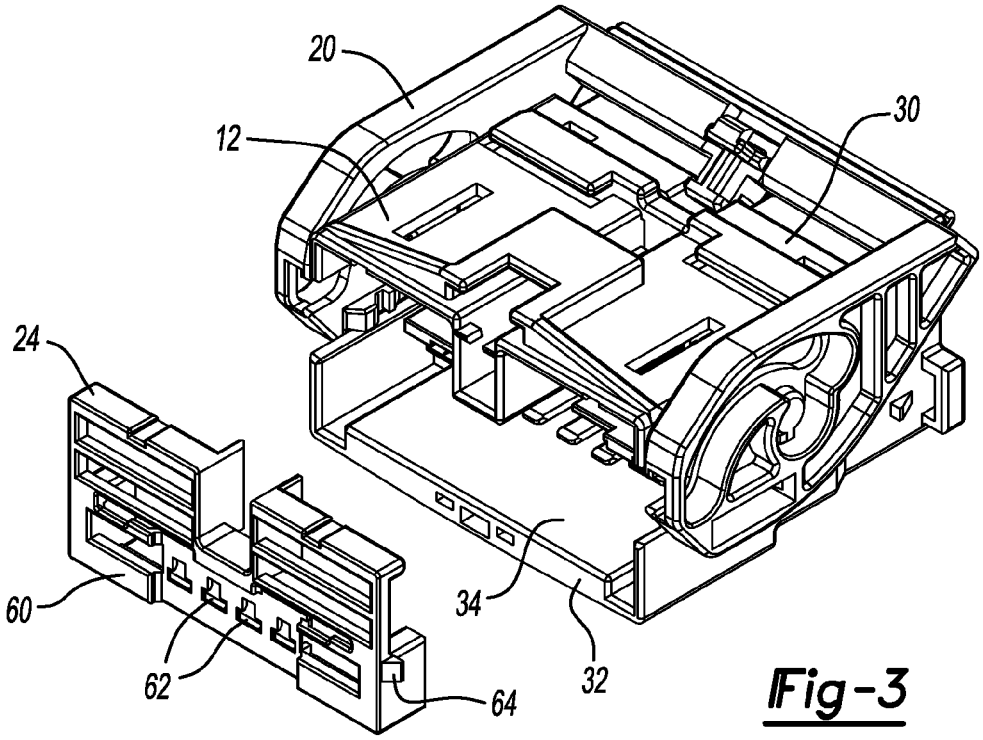
FIG. 3 is an exploded perspective view of a portion of the connector assembly of FIG. 1 depicting a first connector housing, a lever and a male terminal protector in more detail.
Figure 4:
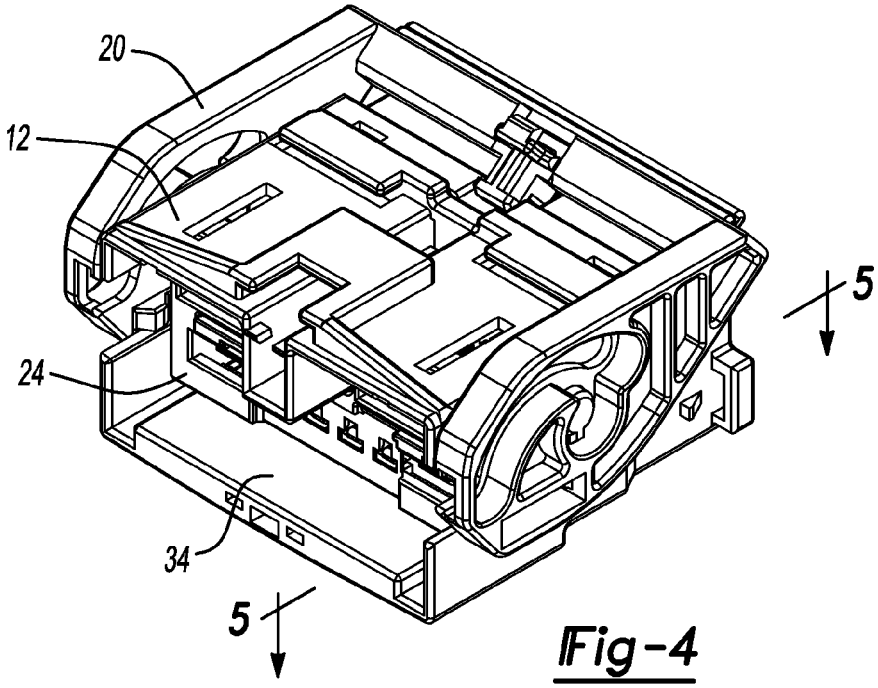
FIG. 4 is a perspective view of the portion of the connector assembly that is depicted in FIG. 3.
Figure 5:
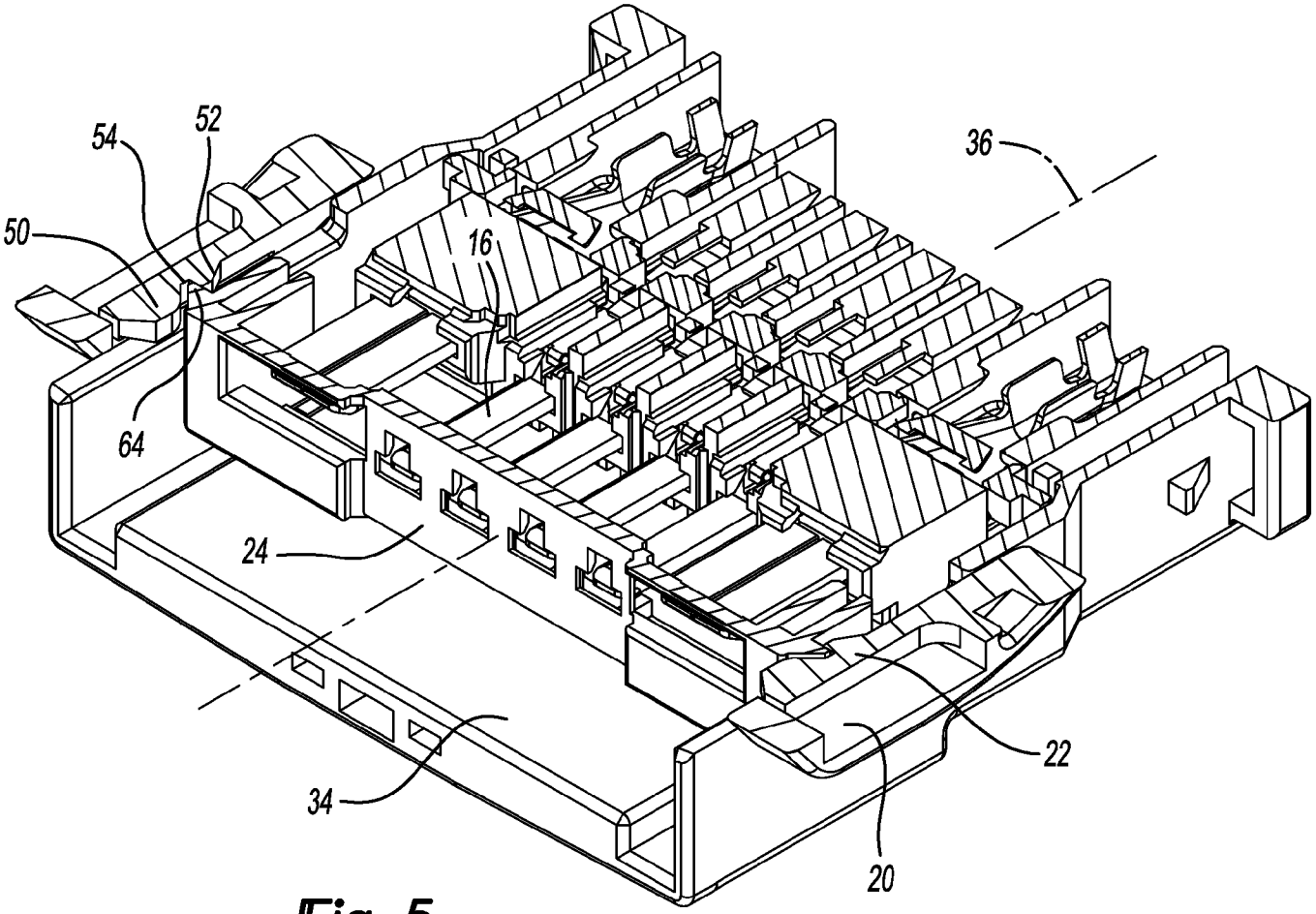
FIG. 5 is a perspective section view taken along the line 5-5 of FIG. 4.

In FIGS. 2 and 3, the first connector housing 12 can have a first connector body 30 and a shroud member 32 that is coupled the first connector body 30. The shroud member 32 can define a connector housing cavity 34 that is disposed about a mating axis 36. The first connector body 30 can define a plurality of first terminal apertures 38 that are formed parallel to the mating axis 36 and intersect the connector housing cavity 34.

The second connector housing 14 can define a plurality of second terminal apertures 40 and is sized to be received into the connector housing cavity 34 and slidable relative to the first connector housing 12 along the mating axis 36 between a connector pre-set position and a connector full-set position.

The male terminals 16 are fixedly coupled to the first connector housing 12. Each of the male terminals 16 is received in one of the first terminal apertures 38 and has a portion 44 that extends into the connector housing cavity 34.

Each of the female terminals 18 is received in a corresponding one of the second terminal apertures 40 in the second connector housing 14. The female terminals 18 are configured to engage the male terminals 16 as will be described in more detail below.

The lever 20 can be pivotably coupled to one of the first and second connector housings 12 and 14 and can be configured to engage the other one of the first and second connector housings 12 and 14 to cause relative movement between the first and second connector housings 12 and 14 that is associated with movement of the second connector housing 14 from the connector pre-set position to the connector full-set position. In the particular example provided, the lever 20 is pivotably coupled to the first connector housing 12 and is configured to engage the second connector housing 14 to draw the second connector housing 14 toward the first connector body 30 (i.e., from the connector pre-set position to the connector full-set position).

The lock tabs 22 can be disposed on opposite sides of the first connector housing 12. Each of the lock tabs 22 can have a first lock tooth 50, a second lock tooth 52, and a lock recess 54 that is disposed between the first and second lock teeth 50 and 52. The first lock teeth 50 can project into the connector housing cavity 34 to a greater extent than the second lock teeth 52. In this regard, the first lock teeth 50 can be relatively larger than the second lock teeth 52 such that a distance between the first lock teeth 50 can be relatively larger than a distance across the second lock teeth 52. Each of the first lock teeth 50 can be disposed on a distal end 56 of an associated one of the lock tabs 22. The proximal end 58 of each lock tab 22 can be resiliently mounted to another structure. In the particular example provided the lock tabs 22 are integrally formed with the lever 20, but it will be appreciated that the lock tabs 22 could be formed directly on the first connector housing 12 in the alternative.

In FIGS. 2 through 5, the male terminal protector 24 can be slidably received in the connector housing cavity 34 and can be disposed between the first connector body 30 and the second connector housing 14. The male terminal protector 24 can be movable along the mating axis 36 and can have a body 60, a plurality of terminal openings 62 and a pair of lock projections 64. The terminal openings 62 can be formed through the body 60 and can be disposed in-line with the male terminals 16. The lock projections 64 are configured to deflect the lock tabs 22 outwardly from the first connector housing 12 as the male terminal protector 24 is moved along the mating axis 36 toward the male terminals 16. The lock projections 64 can be received in the lock recesses 54 to position the male terminal protector 24 relative to the first connector housing 12 in a protector pre-set position. The portions 44 of the male terminals 16 that extend into the connector housing cavity 34 are disposed between first connector body 30 and the male terminal protector 24 when the male terminal protector 24 is in the protector pre-set position. The male terminal protector 24 can be moved along the mating axis toward the first connector body 30 into a protector full-set position in which the portions of the male terminals 16 extend through the male terminal protector 24.

In a typical application, the male terminals 16 can be coupled to associated conductors 70 in a first wire harness 72 and can be installed to the first connector housing 12. The male terminal protector 24 can be received in the connector housing cavity 34 and engaged to the lock tabs 22 so that the lock tabs 22 can retain the male terminal protector 24 in its protector pre-set position. Those of skill in the art will appreciate that contact between the lock projections 64 and the second lock teeth 52 can inhibit movement of the male terminal protector 24 along the mating axis 36 toward the protector full-set position. Those of skill in the art will also appreciate that when so positioned, the male terminal protector can prevent unintended contact between ends of the male terminals and another object, such as the finer of an assembly technician. The female terminals 18 can similarly be coupled to conductors 74 in a second wire harness 76 and can be installed to the second connector housing 14. The second connector housing 14 can be aligned to the connector housing cavity 34 and slid relative to the first connector housing 12 along the mating axis 36 to position the second connector housing 14 in the connector pre-set position, which is shown in FIG. 6. In the connector pre-set position, the female terminals 18 are not engaged to and do not contact the male terminals 16.

With reference to FIGS. 2, 6 and 7, movement of the second connector housing 14 into the connector pre-set position can cause contact between the second connector housing 14 and the lock tabs 22 that causes the distal ends 56 of the lock tabs 22 to deflect outwardly so that the lock projections 64 are disengaged from first and second lock teeth 50 and 52 so that the second lock teeth 52 will not interfere with movement of the male terminal protector 24 toward the protector full-set position. As noted above, the first lock teeth 50 project into the connector housing cavity 34 to a greater extent than the second lock teeth 52 and as such, when they are spread apart to receive the second connector housing 14 there between, the second lock teeth 52 are inherently spread apart by a distance that is sufficient to permit the male terminal protector 24 to slide in an unencumbered manner toward the first connector body 30, particularly when the female terminals 18 are initially contacting the male terminals 16.

Accordingly, the connector assembly 10 is configured so that the male terminal protector 24 can be unlocked from the first connector housing 12 (when the second connector housing 14 is positioned in its connector pre-set position) so that the force required to mate the second connector housing 14 to the first connector housing 12 is not affected by the male terminal protector 24. The lever 20 can be rotated to pull the second connector housing 14 toward the first connector body 30 and into the connector full-set position. It will be appreciated that the male terminals 16 engage the female terminals 18 as the second connector housing 14 is moved from the connector pre-set position to the connector full-set position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connector assembly comprising:

a first connector housing having a first connector body and a shroud member that is coupled the first connector body and defines a connector housing cavity that is disposed about a mating axis, the first connector body defining a plurality of first terminal apertures that are formed parallel to the mating axis and intersect the connector housing cavity;

a plurality of male terminals that are fixedly coupled to the first connector housing, each of the male terminals being received in one of the first terminal apertures and having a portion that extends into the connector housing cavity;

a pair of lock tabs disposed on opposite sides of the first connector housing, each of the lock tabs having a first lock tooth, a second lock tooth, and a lock recess that is disposed between the first and second lock teeth, each of the first lock teeth being disposed on a distal end of an associated one of the lock tabs;

a male terminal protector slidably received in the connector housing cavity and movable along the mating axis, the male terminal protector having a body, a plurality of terminal openings that are formed through the body, and a pair of lock projections, the terminal openings being disposed in-line with the male terminals, the lock projections being configured to deflect the lock tabs outwardly from the first connector housing as the male terminal protector is moved along the mating axis toward the male terminals, the lock projections being disposed in the lock recesses to position the male terminal protector in a protector pre-set position; and a lever that is pivotally coupled to the first connector housing, wherein the lock tabs are coupled to the lever for pivoting motion therewith, wherein the portions of the male terminals that extend into the connector housing cavity are disposed between first connector body and the male terminal protector when the male terminal protector is in the protector pre-set position;

wherein the male terminal protector is moveable along the mating axis toward the first connector body into a protector full-set position in which the portions of the male terminals extend through the male terminal protector.

2. The connector assembly of claim 1, further comprising a second connector housing and a plurality of female terminals, the second connector housing defining a plurality of second terminal apertures, each of the female terminals being received in a corresponding one of the second terminal apertures, the second connector housing being received in the connector housing cavity and movable relative to the first connector housing along the mating axis between a connector pre-set position and a connector full-set position, wherein the second connector housing deflects the lock tabs to disengage the lock projections from the lock recesses when the second connector housing is in the connector pre-set position, and wherein the male terminals are received into the female terminals when the second connector housing is in the connector full-set position.

3. The connector assembly of claim 2, wherein the lever is configured to engage the second connector housing to cause relative movement between the first and second connector housings that is associated with movement of the second connector housing from the connector pre-set position to the connector full-set position.

4. The connector assembly of claim 3, wherein the first lock teeth project into the connector housing cavity to a greater extent than the second lock teeth.

5. The connector assembly of claim 1, wherein the first lock teeth project into the connector housing cavity to a greater extent than the second lock teeth.

6. The connector assembly of claim 1, wherein the lock tabs and lever are integrally formed with each other.

* * * * *